US008213855B2

(12) United States Patent
Shishikura

(10) Patent No.: US 8,213,855 B2
(45) **Date of Patent: *Jul. 3, 2012**

(54) IMAGE FORMING APPARATUS AND PAPER EJECTION METHOD OF IMAGE FORMING APPARATUS

(75) Inventor: Kenichiro Shishikura, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/023,204

(22) Filed: Feb. 8, 2011

(65) Prior Publication Data

US 2011/0123242 A1 May 26, 2011

Related U.S. Application Data

(60) Division of application No. 12/549,030, filed on Aug. 27, 2009, now Pat. No. 7,899,388, which is a division of application No. 12/222,510, filed on Aug. 11, 2008, now Pat. No. 7,599,654, which is a continuation of application No. 11/178,472, filed on Jul. 12, 2005, now Pat. No. 7,426,366.

(30) Foreign Application Priority Data

Jul. 15, 2004 (JP) ..... 2004-209006

(51) Int. Cl.
*G03G 15/00* (2006.01)

(52) U.S. Cl. ..... 399/405; 399/407; 399/397

(58) Field of Classification Search ..... 399/405
See application file for complete search history.

(56) References Cited

U.S. PATENT DOCUMENTS

| | | | | |
|---|---|---|---|---|
| 5,839,044 | A | 11/1998 | Taruki | |
| 6,002,912 | A | 12/1999 | Takeda | |
| 7,146,113 | B2 | 12/2006 | Kitamura | |
| 7,159,863 | B2 | 1/2007 | Murrell et al. | |
| 7,175,173 | B2 | 2/2007 | Anzai et al. | |
| 7,426,366 | B2 * | 9/2008 | Shishikura | 399/405 |
| 7,899,388 | B2 * | 3/2011 | Shishikura | 399/405 |
| 2002/0025207 | A1 | 2/2002 | Yoshie et al. | |
| 2002/0135124 | A1 | 9/2002 | Suzuki et al. | |

FOREIGN PATENT DOCUMENTS

| | | | |
|---|---|---|---|
| JP | 06-056323 | A | 3/1994 |
| JP | 08-241010 | A | 9/1996 |
| JP | 09-104555 | A | 4/1997 |
| JP | 09-221259 | A | 8/1997 |
| JP | 10-226447 | A | 8/1998 |
| JP | 10-324444 | A | 12/1998 |
| JP | 2004-054246 | A | 2/2004 |

* cited by examiner

*Primary Examiner* — Daniel J Colilla
*Assistant Examiner* — Allister Primo
(74) *Attorney, Agent, or Firm* — Foley & Lardner LLP

(57) ABSTRACT

A drive unit for changing the driving rate of paper ejection rollers for ejecting sheets of paper after fixing is installed, and an image forming apparatus has an option, and when ejecting the sheets of paper to an intra-body paper ejection unit, after the sheets of paper pass a fixing device, the paper ejection rate of paper ejection rollers 24 is increased, and the ejection force of the sheets of paper P is increased, and paper jamming at the time of paper ejection to the intra-body paper ejection unit is prevented.

8 Claims, 6 Drawing Sheets

IMAGE FORMING APPARATUS AND PAPER EJECTION METHOD OF IMAGE FORMING APPARATUS

CROSS-REFERENCE TO RELATED APPLICATIONS

The present application is a Divisional of U.S. application Ser. No. 12/549,030, filed Aug. 27, 2009 which is a Divisional of U.S. application Ser. No. 12/222,510, filed Aug. 11, 2008, which is a Continuation of U.S. application Ser. No. 11/178,472, filed Jul. 12, 2005, which claims the benefit of priority from prior Japanese Patent Application No. 2004-209006 filed on Jul. 15, 2004, the entire contents of which are incorporated herein by reference.

FIELD OF THE INVENTION

The present invention relates to an image forming apparatus and a paper ejection method of image forming apparatus for performing a finishing process for sheets of paper after fixing toner images.

DESCRIPTION OF THE BACKGROUND

As an image forming apparatus such as a copier and a printer, there is an apparatus such that the image forming rate is comparatively slow such as ten and several sheets/min. to twenty and several sheets/min. and sheets of paper after image forming are ejected into an intra-body paper ejection unit of the apparatus. In some image forming apparatus having such an image forming rate, to retain the paper ejection property into the paper ejection unit satisfactorily, the paper ejection rollers are provided with a corrugation function, and sheets of paper are stiffened, thus regular paper ejection is realized.

On the other hand, in some image forming apparatus, an optional device such as a finisher having a function for sorting and grouping sheets of paper after image forming or stapling and bundling them or a job separator, in a multiple functional peripheral (hereinafter abbreviated to MFP), for separating and ejecting sheets of paper after image forming by a copier and sheets of paper after image forming by a printer is mounted. In an image forming apparatus, for example, having a finisher as an optional device, if the paper ejection rollers are provided with a corrugation function and sheets of paper P are stiffened, the sheets of paper are apt to be jammed in the relay conveying path from the paper ejection rollers to the finisher. Therefore the paper ejection rollers are generally set not to provide the corrugation function, when using an optional device.

However, even in an image forming apparatus optionally having the finisher like this, without using the optional device, sheets of paper may be ejected using the paper ejection unit on the apparatus body side. However, in the image forming apparatus having the optional device, if it is intended to eject sheets of paper into the paper ejection unit on the apparatus body side, since the paper ejection rollers have no corrugation function, the sheets of paper cannot be stiffened and there is a fear that at the time of paper ejection, the rear end of some sheet of paper may be left at the position of the paper ejection rollers. Particularly, if the height of the paper ejection area is restricted like the intra-body paper ejection unit, sheets of paper may be ejected upward above the horizontal line, and at this time, the rear end of each sheet of paper P is apt to be left at the position of the paper ejection rollers. If the rear end of a preceding sheet of paper is left at the position of the paper ejection rollers like this, the succeeding sheet of paper is caught by the rear end of the preceding sheet of paper at the position of the paper ejection rollers, thus jamming of sheets of paper may be caused.

Therefore, in Japanese Patent Application 8-241010, an apparatus is disclosed that regardless of the image forming rate, after ending of image forming, sheets of paper are ejected at a faster rate than the image forming rate.

However, since the conventional apparatus has a torque limiter on the paper ejection roller pair, before the rear end of a transfer member passes the fixing roller pair, the conveying rate by the fixing roller pair can be controlled, though the conveying rate is always increased when the transfer member passes the fixing roller pair and the load on the sheets of paper by the fixing roller pair is removed. Namely, the conventional apparatus does not speedup and drive the paper ejection roller pair whenever necessary. Therefore, for example, the paper ejection rate must be increased, when ejecting sheets of paper toward the intra-body paper ejection unit, though a problem arises that it cannot be applied to a paper ejection unit of an apparatus required to keep the paper ejection rate almost equal to the image forming rate, when ejecting sheets of paper toward the finisher which is an optional device.

Therefore, in an image forming apparatus having an optional device, an image forming apparatus and a paper ejection method thereof for smoothly ejecting sheets of paper after fixing to either of the optional device side and intra-body paper ejection unit side free of paper jamming are desired.

SUMMARY OF THE INVENTION

Accordingly, an advantage of the present invention is to provide an image forming apparatus having an optional device and a paper ejection method thereof for improving the good conveying of sheets of paper in a paper ejection unit and even if ejecting the sheets of paper to an intra-body paper ejection unit, causing no paper jamming.

To achieve the above advantage, one aspect of the present invention is to provide an image forming apparatus comprising, an image forming portion to form a toner image on a recording media, a fixing unit to clamp and convey said recording media and fixing said toner image, an ejection unit installed on a downstream side of said fixing unit to eject said recording media, an intra-body paper ejection unit to stack said recording media ejected from said ejection unit, a relay unit to convey said recording media ejected from said ejection unit in an optional direction, and a drive unit to drive said ejection unit at a first rate when said ejection unit ejects said recording media toward said relay unit and to drive said ejection unit at a second rate faster than said first rate when said ejection unit ejects said recording media toward said intra-body paper ejection unit, after said recording media passes said fixing unit.

DETAILED DESCRIPTION OF THE INVENTION

Figure 1:
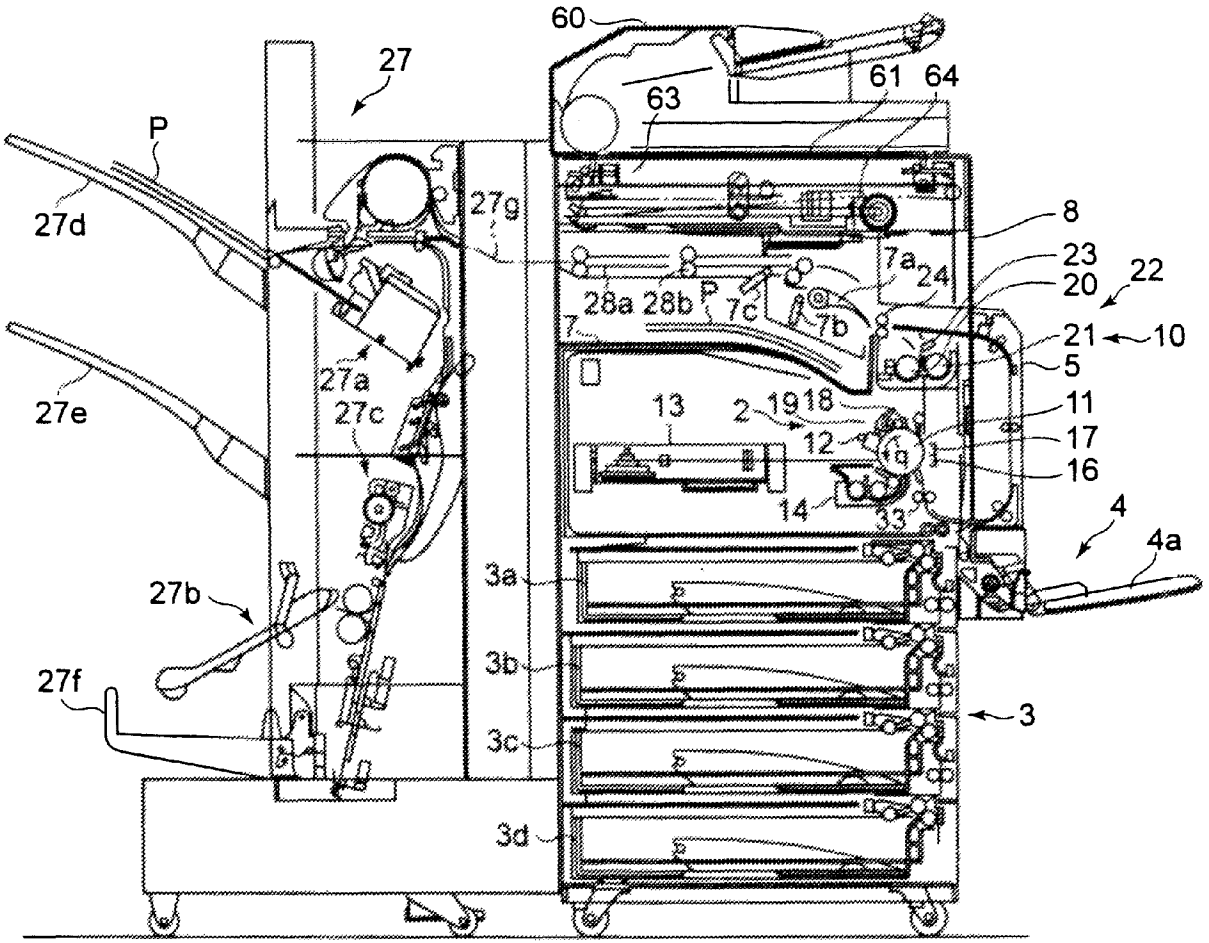
FIG. 1 is a schematic block diagram showing the copier of the embodiment of the present invention.

Hereinafter, the embodiment of the present invention will be explained in detail with reference to the accompanying drawings. FIG. 1 is a schematic block diagram showing a copier 10, which is an image forming apparatus of the embodiment of the present invention. The image forming rate of the copier 10 is set at ten and several sheets/min. to twenty and several sheets/min. Above an apparatus body 8 of the copier 10, a scanner 6 for reading document images is mounted. The scanner 6 has a platen glass 61 for setting documents supplied from an automatic document feeder 60, an optical unit 63 for irradiating light onto a document and focusing the reflected light from the document, and a CCD scanner unit 64 for reading the light from the optical unit 63.

Under the scanner 6 across an intra-body paper ejection unit 7 of the apparatus body 8, a photosensitive drum 11 and an image forming unit 2, which is an image forming portion are mounted. In the rotational direction of the arrow q of the photosensitive drum 11, the image forming unit 2 includes a main charger 12 for uniformly charging the photosensitive drum 11, a laser exposure device 13 for forming a latent image on the charged photosensitive drum 11 on the basis of image data from the scanner 6, a developing device 14, a transfer charger 16, a separation charger 17, a cleaner 18 which is a toner collection unit, and a discharging LED 19 sequentially.

Under the apparatus body 8, there is a cassette mechanism 3 having paper supply cassettes 3*a* to 3*d* for supplying sheets of paper P which are recording media, in the direction of the transfer position of the photosensitive drum 11. Furthermore, the apparatus body 8 includes a manual paper supply mechanism 4 for supplying sheets of paper P from a paper supply tray 4*a* and a reversible conveying mechanism 5 for reversing sheets of paper P at the time of double-side image forming. Numeral 33 indicates aligning rollers for aligning the front ends of sheets of paper P supplied from the cassette mechanism 3 and the manual paper supply mechanism 4 or the reversible conveying mechanism 5 and conveying them toward the photosensitive drum 11 in synchronization with a toner image.

On the downstream side of the transfer position of the photosensitive drum 11, a fixing device 22 which is a fixing unit for clamping and conveying sheets of paper P by a heat roller 20 and a press roller 21 and heating, pressurizing, and fixing toner images is mounted. On the downstream side of the fixing device 22, a paper sensor 23 for detecting the front end of each sheet of paper P and paper ejection rollers 24 composed of an upper and lower paper ejection roller pair 24*a* and 24*b* which is a paper ejection unit for ejecting sheets of paper P after fixing from the apparatus body 8 are mounted. The paper ejection rollers 24, by a paper ejection roller driver 34*a* which is a drive unit described later, are switched to a driving rate of 133 mm/s which is the first rate almost similar to the image forming rate by the image forming unit 2 and a driving rate of 250 mm/s faster than the first rate.

To the apparatus body 8, a finisher 27, which is optional, is attached. Further, between the paper ejection rollers 24 and the finisher 27 on the upper part of the intra-body paper ejection unit 7, a relay unit 28 having a relay guide 28*a* and relay rollers 28*b* to relay sheets of paper P ejected by the paper ejection rollers 24 to the finisher 27 is arranged. Further, on the intra-body paper ejection unit 7, a gate mechanism 7*a* for distributing the sheets of paper P ejected from the paper ejection rollers 24 to the intra-body paper ejection unit 7 or the relay guide 28*a* is mounted. Furthermore, above the intra-body paper ejection unit 7, a height sensor 7*b* for detecting the height of sheets of paper P in the intra-body paper ejection unit 7 and a full sensor 7*c* for detecting that the intra-body paper ejection unit 7 is full are mounted. The relay unit 28 may be incorporated into the apparatus body 8 from the beginning or may be set removable so as to mount when necessary.

The finisher 27 includes a staple unit 27*a*, a saddle stitcher 27*b*, an intermediate paper pass section 27*c*, an upper stack tray 27*d*, a lower stack tray 27*e*, and a paper receiving tray 27*f*. Sheets of paper P relayed from the paper ejection rollers 24 to the relay unit 28 are sent to the finisher 27 via a paper path 27.

Figure 2:
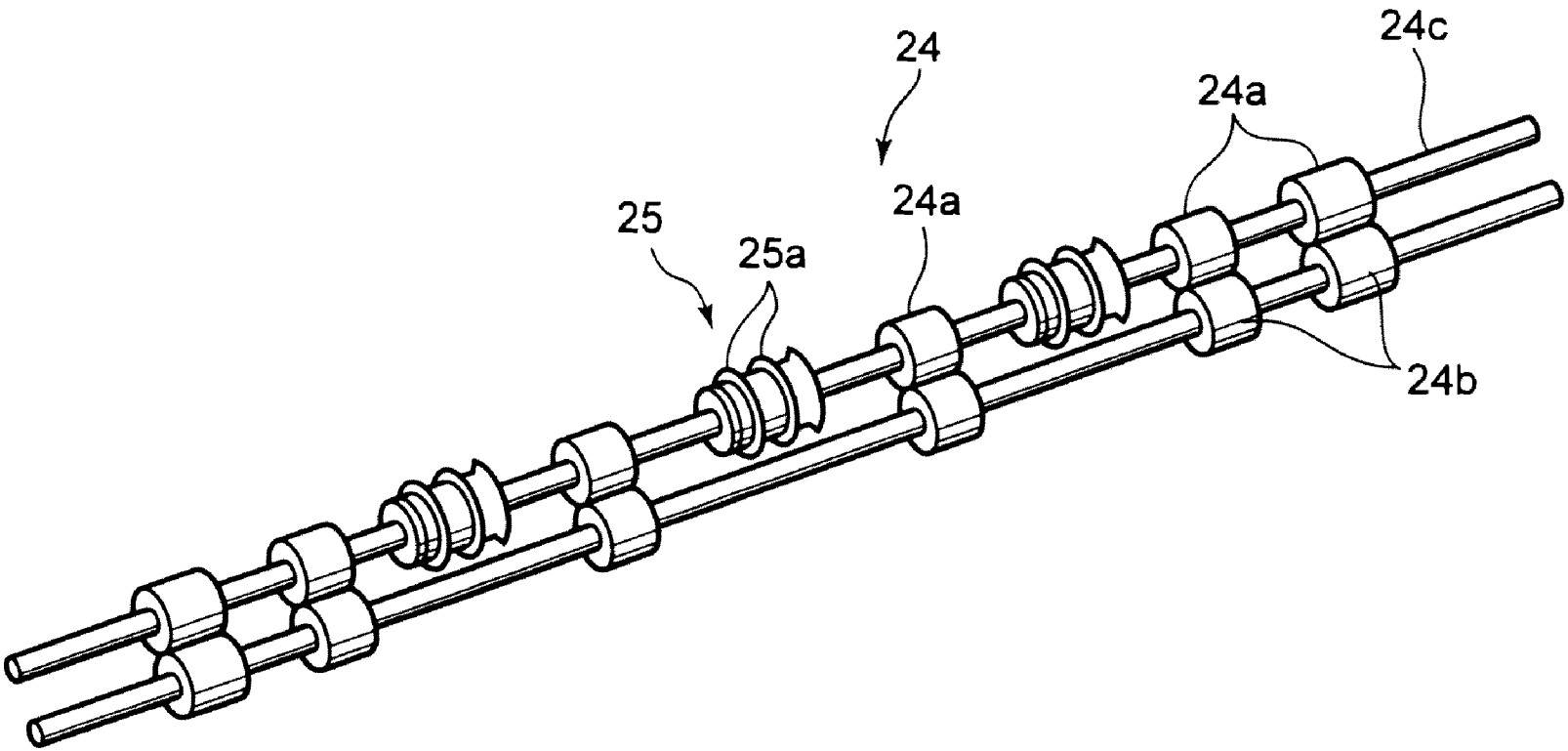
FIG. 2 is a schematic perspective view showing the paper ejection rollers of the embodiment of the present invention.
Figure 3:
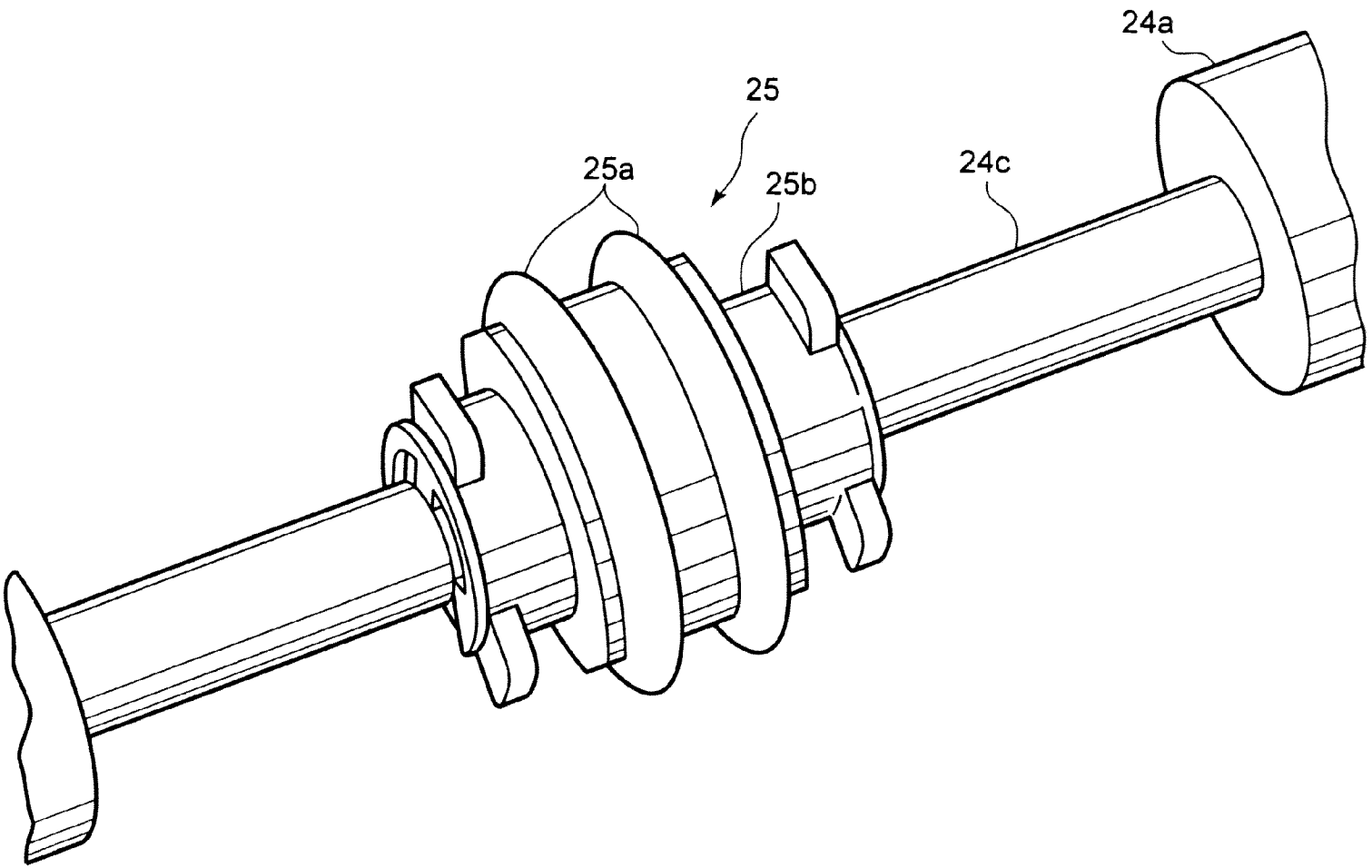
FIG. 3 is a schematic perspective view showing the corrugation roller of the embodiment of the present invention.

As shown in FIGS. 2 and 3, to a shaft 24*c* of upper paper ejection rollers 24*a* of the paper ejection rollers 24, a corrugation roller 25 is attached. By rubber members 25*a* fit in the corrugation roller 25, the section of each of sheets of paper P ejected by the paper ejection rollers 24 is bent in waves and is stiffened. However to prevent the relay unit 28 from paper jamming the rubber member 25*a* of the corrugation roller 25 are removed in slits 25*b* formed on both sides of the corrugation roller 25, when the apparatus body 8 is optionally provided with the finisher 27.

Figure 4:
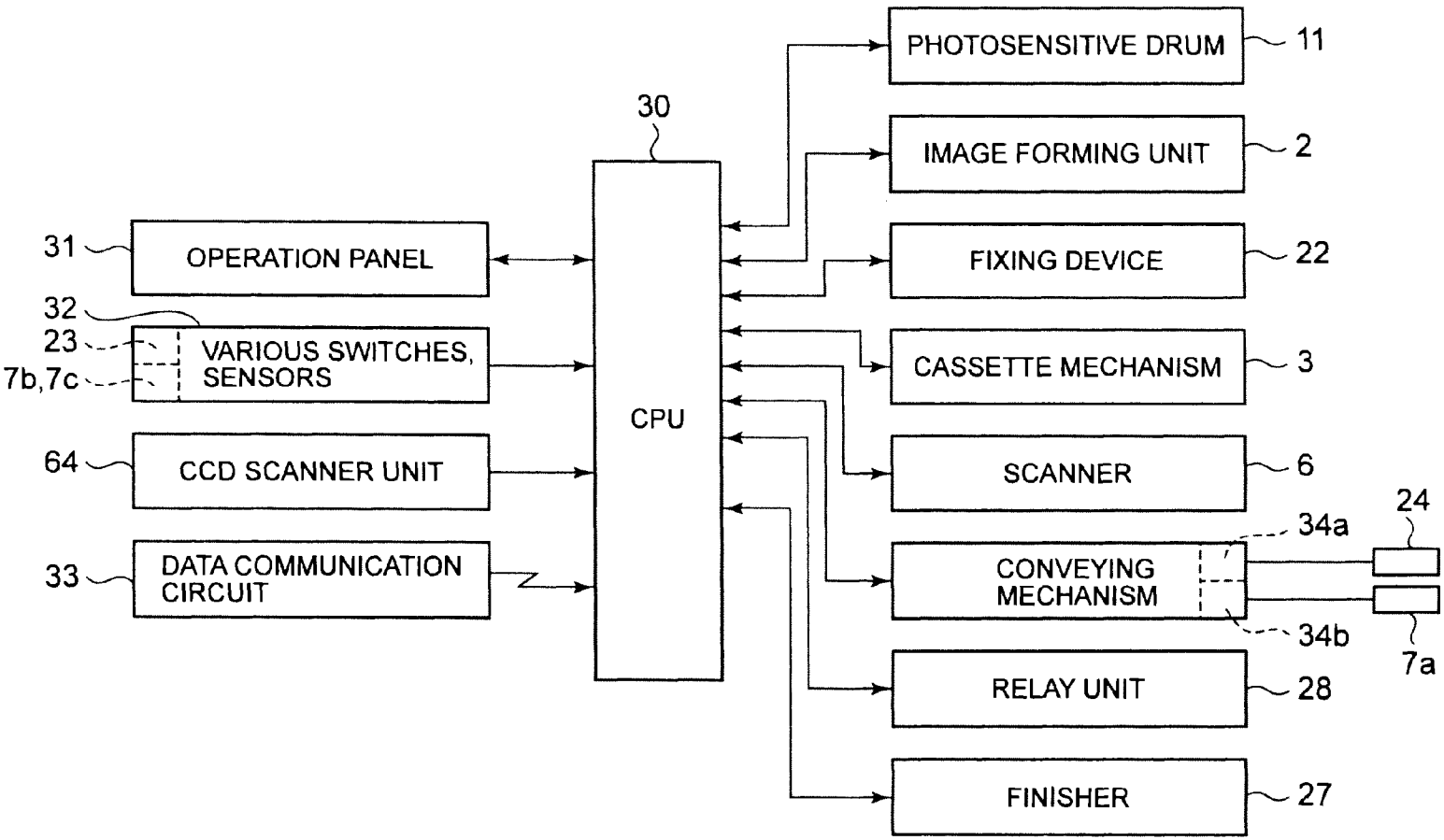
FIG. 4 is a block diagram showing the control system of the copier of the embodiment of the present invention.

Next, the control system of the copier 10 will be explained by referring to the block diagram shown in FIG. 4. To the input side of a CPU 30 for controlling the whole copier 10, various switches and sensors 32 including the paper sensor 23, the height sensor 7*b*, and the full sensor 7*c* are connected. Additionally to the input side of the CPU 30, a data communication line 33 for transmitting image information from the computer terminal is connected. Furthermore, to the CPU 30, an operation panel 31 for inputting image forming conditions such as the print mode, selection of sheets of paper, the number of sheets, etc., the photosensitive drum 11, the image forming unit 2, the fixing device 22, the cassette mechanism 3, the scanner 6, the finisher 27, the relay unit 28, etc. are connected and a conveying mechanism 34 of sheets of paper P is also connected. The conveying mechanism 34 has a paper ejection roller driver 34*a* for driving the paper ejection rollers 24 at 133 mm/s or 250 mm/s, which is faster than it. Further, the conveying mechanism 34 has a gate driver 34*b* for driving the gate mechanism 7*a*.

The CPU 30 sets paper ejection mode of the copier 10 to the intra-body paper ejection mode, which is the first mode when the finisher 27 is not mounted on the apparatus body 8, and sets paper ejection mode of the copier 10 to the option mode, which is the second mode when the finisher 27 is mounted on the apparatus body 8. The first mode or second mode is set from the operation panel 31 by a service man when attaching the finisher 27. Further, the first mode or second mode may be designed to be automatically set by connecting the finisher 27 to the apparatus body 8.

Figure 5:
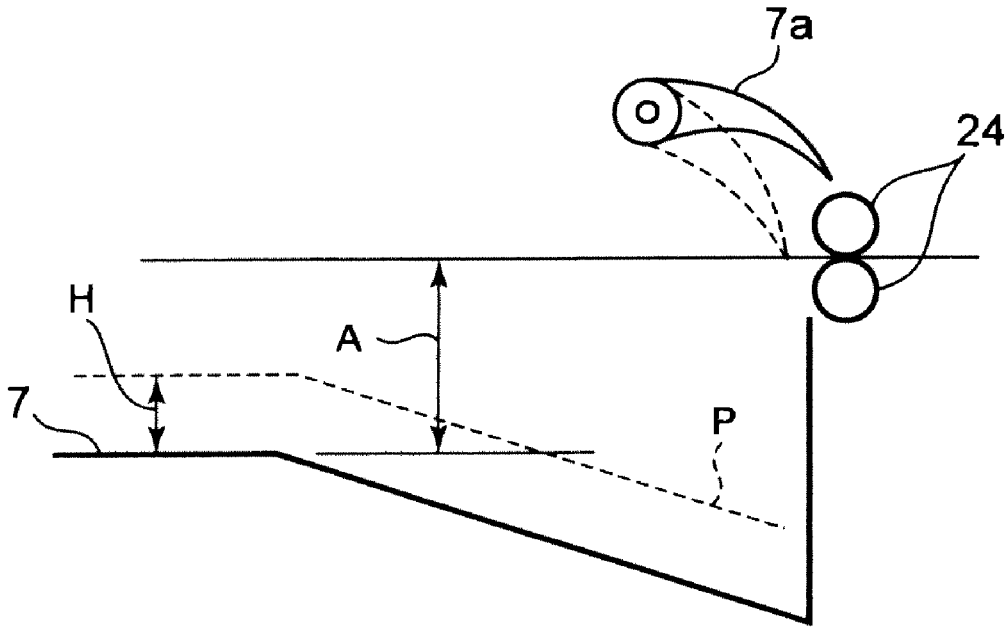
FIG. 5 is a schematic illustration showing ejection of a sheet of paper to the intra-body paper ejection unit of the embodiment of the present invention.

In the intra-body paper ejection mode, the CPU 30 controls the paper ejection roller driver 34*a* so as to drive the paper ejection rollers 24 at 133 mm/s. Further, in the option mode, the CPU 30 controls the paper ejection roller driver 34*a* so as to drive the paper ejection rollers 24 at 133 mm/s, when the finisher 27 is selected from the operation panel 31 by a user and the gate mechanism 7*a* is in the position indicated by a dotted line in FIG. 5. Furthermore, in the option mode, the CPU 30 controls the paper ejection roller driver 34*a* so as to drive the paper ejection rollers 24 at 250 mm/s to which the driving rate is increased, when the intra-body paper ejection unit 7 is selected from the operation panel 31 by the user, and the gate mechanism 7*a* is in the position indicated by a solid line in FIG. 5, and the height H of sheets of paper P stacked on the intra-body paper ejection unit 7 reaches the height A from the bottom of the intra-body paper ejection unit 7 to the nipping section of the paper ejection rollers 24. By doing this, the ejection force of the sheets of paper P to the intra-body paper ejection unit 7 is increased. Namely, even after the front ends of the sheets of paper P ejected by the paper ejection rollers 24 collide with the sheets of paper P stacked on the intra-body paper ejection unit 7, the ejection rate of the sheets of paper P can be retained and the rear ends of the sheets of paper P are prevented from leaving at the position of the paper ejection rollers 24 due to reduction in the ejection force.

Therefore, even if the intra-body paper ejection unit 7 is selected from the operation panel 31 by the user the CPU 30 controls the paper ejection roller driver 34*a* so as to drive the paper ejection rollers 24 at 133 mm/s, when the sheets of paper P stacked on the intra-body paper ejection unit 7 are few and the height H thereof does not reach the height A from the bottom of the intra-body paper ejection unit 7 to the nipping section of the paper ejection rollers 24. By doing this the ejection force of the sheets of paper P is increased due to speeding up of the paper ejection rollers 24, when the sheets of paper P, after passing the paper ejection rollers 24, are ejected upward from the nipping section of the paper ejection rollers 24.

Whether the height H of the sheets of paper P stacked on the intra-body paper ejection unit 7 reaches the height A from the bottom of the intra-body paper ejection unit 7 to the nipping section of the paper ejection rollers 24 or not is detected by the height sensor 7*b* and is input to the CPU 30. Further, the height A from the bottom of the intra-body paper ejection unit 7 to the nipping section of the paper ejection rollers 24 varies with the maximum paper ejection capacity of the intra-body paper ejection unit 7.

Next, the operation of the invention will be described. When the copier 10 is in the option mode a user sets various image forming conditions and can select a finish processing condition of sheets of paper P, when starting the image forming process. Namely, user selects, as a finish processing condition, either of paper ejection to the intra-body paper ejection unit 7 or paper ejection to the finisher 27 via the relay unit 28. When the image forming process starts, the scanner 6 reads a document. In the image forming unit 2, the photosensitive drum 11 is uniformly charged by the main charger 12 and then is irradiated with a laser beam according to a document image by the laser exposure device 13 to form an electrostatic latent image according to the rotation in the direction of the arrow q. Then, the developing device 14 develops the electrostatic latent image on the photosensitive drum 11 and a toner image is formed on the photosensitive drum 11.

In synchronization with forming of the toner image, a predetermined sheet of paper P is sent from the cassette mechanism 3 or the manual paper supply mechanism 4 to the position of the transfer charger 16 and the toner image on the photosensitive drum 11 is transferred to it. Next, the sheet of paper P is separated from the photosensitive drum 11 and then is clamped and conveyed between the heat roller 20 and the press roller 21 of the fixing device 22, and the toner image is heated, pressurized, and fixed and then reaches the paper ejection rollers 24. At this time, the paper sensor 23 detects the front end of the sheet of paper P. The photosensitive drum 11, after ending of transfer, is cleaned the residual toner by the cleaner 18, is removed the residual charge by the discharging LED 19, and waits for the next image forming process.

Figure 6:
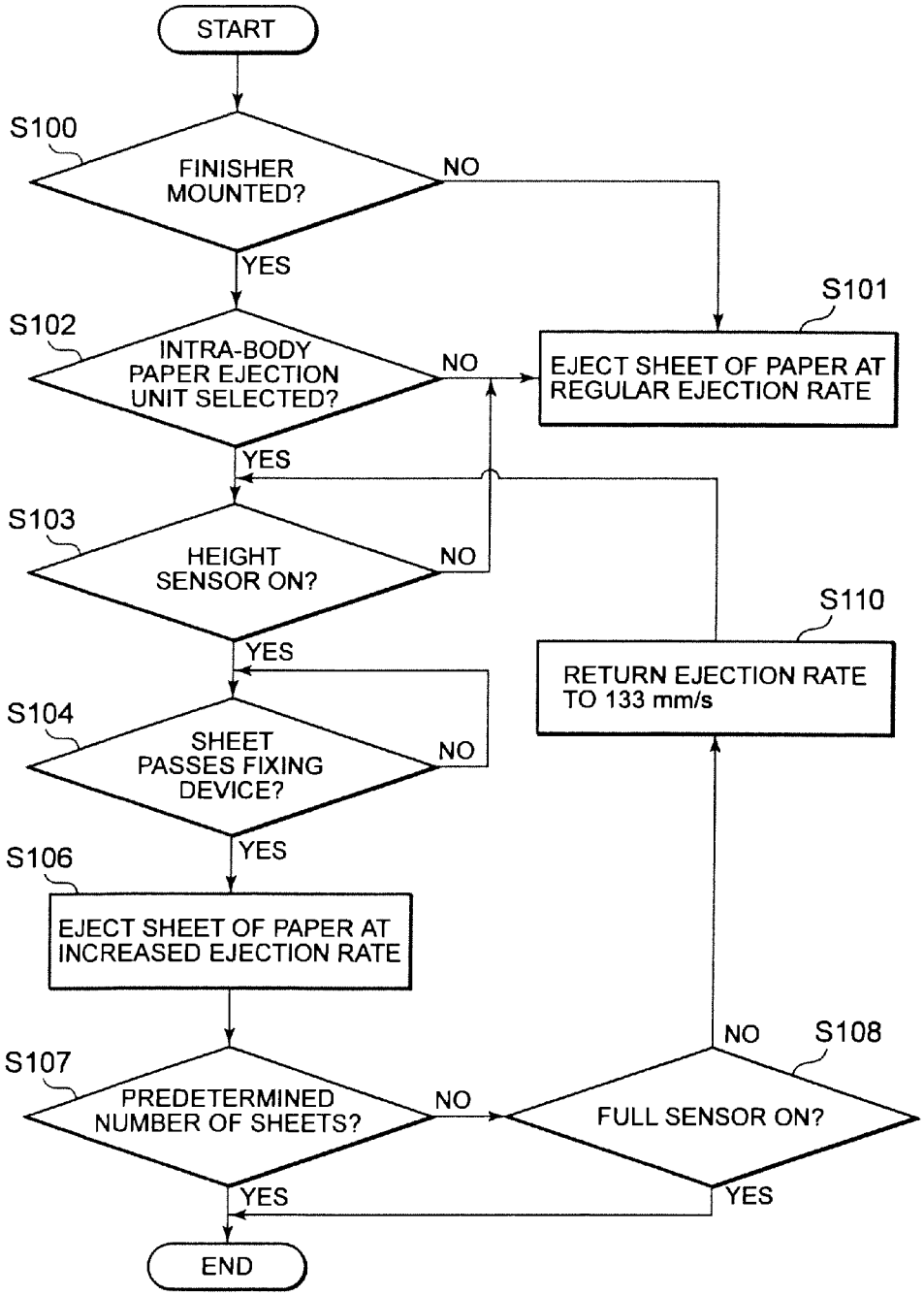
FIG. 6 is a flow chart showing the ejection process of sheets of paper of the embodiment of the present invention.

Next, the ejection process of sheets of paper P by the paper ejection rollers 24 will be explained by referring to the flow chart shown in FIG. 6. When the image forming process starts, at Step 100, whether the copier 10 has the finisher 27 or not is compared. In the intra-body paper ejection mode in which the copier 10 does not have the finisher 27, the process goes to Step 101 and at the regular ejection rate of 133 mm/s of sheets of paper P by the paper ejection rollers 24, the sheets of paper P are ejected to the intra-body paper ejection unit 7 of the apparatus body 8.

When the copier 10 is in the intra-body paper ejection mode, as shown in FIG. 2, the rubber members 25*a* are fit into the corrugation roller 25 of the paper ejection rollers 24. By doing this, the sheets of paper P ejected to the intra-body paper ejection unit 7 are stiffened by the corrugation roller 25 and good paper ejection is obtained, until the intra-body paper ejection unit 7 is filled up. Further, when the copier 10 is in the option mode, the rubber members 25*a* are removed in the slits 25*b* on both sides of the corrugation roller 25.

When the copier 10, at Step 100, is in the option mode in which it is provided with the finisher 27, the process goes to Step 102 and whether the user selects paper ejection to the intra-body paper ejection unit 7 by the finish process or not is compared.

When the user selects paper ejection to the finisher 27, the process goes to Step 101, and at the regular ejection rate of 133 mm/s of sheets of paper P by the paper ejection rollers 24, the image forming process is executed, and the sheets of paper P are ejected toward the finisher 27. By doing this, the sheets of paper P are ejected to the upper stack tray 27*d* or the lower stack tray 27*e* of the finisher 27 via the relay unit 28 or after a predetermined stapling process or a twofold process is executed, are ejected to the upper and lower stack trays 27*d* and 27*e* or the paper ejection tray 27*f*.

On the other hand, when the user selects paper ejection to the intra-body paper ejection unit 7 at Step 102, the process goes to Step 103. At Step 103, whether the height H of the sheets of paper P stacked on the intra-body paper ejection unit 7 reaches the height A from the bottom of the intra-body paper ejection unit 7 to the nipping section of the paper ejection rollers 24 and the height sensor 7*b* is turned on or not is compared.

When the stack amount of sheets of paper P stacked in the intra-body paper ejection unit 7 is small and the height sensor 7*b* is off, the process goes to Step 101, and at the regular ejection rate of 133 mm/s of sheets of paper P by the paper ejection rollers 24, the sheets of paper P are ejected toward the intra-body paper ejection unit 7. When the height H of the sheets of paper P stacked in the intra-body paper ejection unit 7 reaches the height A from the bottom of the intra-body paper ejection unit 7 to the nipping section of the paper ejection rollers 24 and the height sensor 7*b* is turned on, the process goes to Step 104.

At Step 104, it is confirmed that the sheets of paper P pass the fixing device 22. At Step 104 the process goes to Step 106, when the front end of each sheet of paper P is detected by the paper sensor 23, and then a predetermined time elapses, and passing of the rear end of a sheet of paper P of, for example, size B4 through the fixing device 22 is recognized. At Step 106, at an increased ejection rate from 133 mm/s to 250 mm/s of sheets of paper P by the paper ejection rollers 24, the sheets of paper P are ejected toward the intra-body paper ejection unit 7.

By doing this, the ejection force of the sheets of paper P ejected from the paper ejection rollers 24 to the intra-body paper ejection unit 7 is increased and although the sheets of paper P are ejected upward from the nipping section of the paper ejection rollers 24, they are surely ejected onto the intra-body paper ejection unit 7 without the rear ends of the sheets being caught by the paper ejection rollers 24. Hereafter, the image forming process is repeated, and at Step 107, whether the sheets reach a predetermined number or not are compared, and when the sheets reach the predetermined number, the image forming process is finished. When the image forming process does not reach the predetermined number, at Step 108, whether sheets of paper P become full in the intra-body paper ejection unit 7 and the full sensor 7*c* is turned on or not is detected. When it is detected at Step 108 that the full sensor 7*c* is on, even if the sheets do not reach the predetermined number, the image forming process is finished.

When full of sheets is not detected at Step 108, the ejection rate of sheets of paper P by the paper ejection rollers 24 is returned to 133 mm/s at Step 110 and then the process goes to Step 103. Hereafter, at Step 107, until sheets of paper reach the predetermined number, the processes from Step 103 to Step 110 are repeated. Namely, the paper ejection rollers 24 drive sheets at 133 mm/s until they pass the fixing device 22 and drive at a higher rate of 250 mm/s after the rear ends of sheets of paper P pass the fixing device 22.

According to this embodiment, since the finisher 27 is provided optionally, when the section of each sheet of paper P cannot be stiffened in waves by the corrugation roller 25 of the paper ejection rollers 24, if sheets of paper P are stacked in the intra-body paper ejection unit 7 and the height thereof reaches the nip position of the paper ejection rollers 24, after the sheets of paper P pass the fixing device 22, the paper ejection rate of the paper ejection rollers 24 is increased immediately. By doing this, the ejection force of the sheets of paper P to the intra-body paper ejection unit 7 is increased, and even if the front ends thereof collide with the sheets of paper P stacked in the intra-body paper ejection unit 7, there is no fear that the rear ends of the sheets of paper P are left at the position of the paper ejection rollers 24 due to reduction in the ejection force and are surely ejected. Therefore, the succeeding sheets of paper are not jammed due to the sheets of paper left at the position of the paper ejection rollers 24 and the convey-ability thereof can be improved.

Further, generally, when sheets of paper P are speeded up and ejected, compared with a case of paper ejection at the regular rate, paper ejection is apt to be disordered. However, in this embodiment, until the height of sheets of paper P stacked on the intra-body paper ejection unit 7 reaches the nip position of the paper ejection rollers 24, the sheets of paper P are ejected at the regular rate, so that the disorder of paper ejection can be reduced inasmuch as is possible, and the disturbance of alignment at the time of paper ejection can be minimized, and paper jamming can be prevented.

Further, the present invention is not limited to the aforementioned embodiment and can be modified variously within the scope of the present invention. For example, the image forming rate of the image forming apparatus and the ejection rate of sheets of paper by the paper ejection rollers are not restricted and the second rate of the paper ejection rollers, in an apparatus having an option for paper ejection, when the ejection force of sheets of paper to the intra-body paper ejection unit at the first rate is reduced, may be a rate increased from the first rate so as to increase the ejection force of sheets of paper. Further, the optional function and structure are quite optional. Furthermore, in an image forming apparatus having an option, paper ejection rollers having no mounted corrugation roller from the beginning may be used. Further, when the relay unit can be removable attached to the apparatus body, it is possible to detect whether the relay unit is mounted or not and switch the mode to the intra-body paper ejection mode or the option mode.

Further, the timing to speed up the paper ejection rollers from the first rate to the second rate is optional if sheets of paper can be prevented from jamming at the time of paper ejection to the intra-body paper ejection unit and for example, when ejecting into the intra-body paper ejection unit, the paper ejection rollers may be always driven at the second rate. However, as the timing of switching the first rate of the paper ejection rollers to the second rate is delayed, the ejection alignment of sheets of paper can be improved.

Further, to retain the paper ejection alignment satisfactorily, it is preferable not to speed up the paper ejection rollers to the second rate inasmuch as is possible, so that the size of a recording medium requiring speeding-up of the paper ejection rollers may be restricted. For example, when the length of a recording medium in the conveying direction is short, the height of sheets of paper stacked in the intra-body paper ejection unit is increased, and the front end of each of sheets of paper ejected from the paper ejection rollers collides with the stacked sheets of paper, thus even if the ejection force thereof is reduced, the sheet of paper P is surely dropped on the intra-body paper ejection unit, thereby the rear end thereof will not be left at the position of the paper ejection rollers. In such a case, speeding-up of the paper ejection rollers is not necessary. Therefore, for large-scale recording media such as recording media of Size A3 or B4 of JIS Standard which may be jammed when the height of sheets of paper stacked in the intra-body paper ejection unit is increased and only for the Size A4R or Size B4R of JIS Standard, when the height of sheets of paper stacked in the intra-body paper ejection unit reaches a predetermined height, the paper ejection rollers may be speeded up. When speeding-up of the paper ejection rollers intending to prevent paper jamming when ejecting sheets of paper to the intra-body paper ejection unit is suppressed inasmuch as is possible like this, the ejection alignment of sheets of paper can be improved.

As described in detail, according to the present invention, when ejecting sheets of paper to the intra-body paper ejection unit in the image forming apparatus having an option, paper jamming due to insufficient paper ejection force of recording media can be prevented, and the alignment of recording media can be retained satisfactorily inasmuch as is possible, and the convey-ability of recording media to the intra-body paper ejection unit can be improved.

What is claimed is:

1. An image forming apparatus comprising:

an image forming portion to form a toner image on a recording media;

a fixing unit to clamp and convey said recording media and fixing said toner image;

an ejection unit installed on a downstream side of said fixing unit to eject said recording media;

an intra-body paper ejection unit to stack said recording media ejected from said ejection unit; and a control unit to set said ejection unit as an intra-body paper ejection mode to at a first rate when a relay unit to relay said recording media toward an option, while to set said ejection unit as an option mode to drive at said first rate when said relay unit is mounted and said recording media is ejected toward said option, and to drive said ejection unit at a second rate faster than said first rate when said relay unit is mounted, said recording media pass a fixing unit and said recording media is ejected toward said intra-body paper ejection unit.

2. The image forming apparatus according to claim 1, wherein said option mode drives said ejection unit at said second rate when a height of said recording media stacked in said intra-body paper ejection unit is equivalent to a nip position of said ejection unit or higher.

3. The image forming apparatus according to claim 1, wherein said option mode drives said ejection unit at said second rate when a length of said recording media is a fixed length or longer.

4. The image forming apparatus according to claim 1, wherein said first rate is almost similar to a clamping and conveying rate of said recording media by said fixing unit.

5. A paper ejection method of an image forming apparatus comprising:

detecting whether a relay unit is mounted to convey recording media in an optional direction after said recording media is fixed, first mode setting a paper ejection mode to an intra-body paper ejection mode for ejecting said recording media to an intra-body paper ejection unit at a first rate when non-mounting of said relay unit is detected at said detecting, and second mode setting a paper ejection mode to an option mode for ejecting said recording media at said first rate when mounting of said relay unit is detected at said detecting and said recording media is ejected toward said relay unit, and for ejecting said recording media at a second rate faster than said first rate when mounting of said relay unit is detected at said detecting, said recording media pass a fixing unit and said recording media is ejected toward said intra-body paper ejection unit.

6. The paper ejection method of an image forming apparatus according to claim 5, wherein said option mode ejects said recording media at said second rate when a height of said recording media stacked in said intra-body paper ejection unit is equivalent to a nip position of said ejection unit or higher.

7. The paper ejection method of an image forming apparatus according to claim 5, wherein said option mode drives said recording media at said second rate when a length of said recording media is a fixed length or longer.

8. The paper ejection method of an image forming apparatus according to claim 5, wherein said first rate is almost similar to a fixing rate of said recording media.

* * * * *